United States Patent [19]

Noyes et al.

[11] 4,334,471

[45] Jun. 15, 1982

[54] REFERENCE PRINTING ON MOVING SURFACE

[75] Inventors: Mark S. Noyes, Keene; Andrew G. Perra, Jr., North Swanzey, both of N.H.

[73] Assignee: Markem Corporation, Keene, N.H.

[21] Appl. No.: 179,237

[22] Filed: Aug. 18, 1980

[51] Int. Cl.[3] ..... B41F 13/02

[52] U.S. Cl. ..... 101/228; 101/181; 101/235; 101/245

[58] Field of Search ..... 101/181, 228, 248; 226/27; 101/233, 234, 235, 245

[56] References Cited

U.S. PATENT DOCUMENTS

| | | | |
|---|---|---|---|
| 2,500,230 | 3/1950 | Bailey et al. | 101/181 |
| 2,583,580 | 1/1952 | Ludwig | 101/181 X |
| 3,068,787 | 12/1962 | Dall'Oglio et al. | 101/181 |
| 3,537,393 | 11/1970 | Hegi | 101/235 |
| 3,559,568 | 2/1971 | Stanley | 101/181 X |
| 3,970,000 | 7/1976 | Rowley | 101/181 |
| 4,016,467 | 4/1977 | Hallenbeck | 101/235 X |
| 4,023,489 | 5/1977 | Beery | 101/245 X |
| 4,057,014 | 11/1977 | Thomas | 101/181 X |
| 4,093,056 | 6/1978 | Burgers | 101/235 X |
| 4,220,084 | 9/1980 | MacLenn et al. | 101/245 X |

FOREIGN PATENT DOCUMENTS

| | | | |
|---|---|---|---|
| 2827942 | 1/1980 | Fed. Rep. of Germany | 101/181 |

*Primary Examiner*—Edward M. Coven

[57] ABSTRACT

A printing system is disclosed which permits the printing of indicia on a continuously moving web at a fixed position offset from previously printed, evenly spaced web marks. The fixed position of the printed indicia relative to the web marks is independent of the velocity of the web. A web mark sensor, which may be part of the system to which the present invention is retrofitted, detects the passage of each previously printed web mark past a detection position. A registration circuit controls the timing of the printing of the indicia on the moving web and provides START signals for a servomotor-driven rotary print head which includes one or more peripherally mounted printing elements. A tachometer is mechanically coupled to a web transport mechanism to produce an output voltage which provides the velocity command for the servomotor drive of the rotary print head to match the rotational velocity of the print head to the linear velocity of the web during the printing interval. A STOP signal is produced by the registration circuit in response to the rotation of a vane, which rotates in conjunction with the print head, past a vane sensor to signal the rotation of a printing element to a rest position. A registration adjustment circuit permits the position at which the indicia are printed on the web to be varied.

12 Claims, 14 Drawing Figures

NEGATIVE TACHOMETER VOLTAGE

WEB SIGNAL

OUTPUT OF ONE SHOT MV 124

OUTPUT VOLTAGE FROM INTEGRATOR 116
NEGATIVE OF COMPARISON VOLTAGE FROM POTENTIOMETER 148

OUTPUT FROM COMPARATOR 136

"START" SIGNAL PRODUCED BY OUTPUT OF ONE SHOT MV 158

OUTPUT FROM VANE DETECTOR 42

OUTPUT FROM FLIP-FLOP 164

OUTPUT FROM ANALOG SWITCH 183

"STOP" SIGNAL PRODUCED BY OUTPUT OF ONE SHOT MV 166

REFERENCE PRINTING ON MOVING SURFACE

BACKGROUND OF THE INVENTION

1. Field of the Invention

The invention relates to printing systems which form evenly spaced indicia on a moving web at locations which are controlled by previously printed, evenly spaced web marks.

2. Description of the Prior Art

Printing systems are known which print evenly spaced indicia on a continuously moving web at locations which are controlled by previously printed, evenly spaced web marks. These systems are used for both color and non-color printing. See, for example, U.S. Pat. No. 3,152,542. Moreover, cutting systems are known which cut a continuous web into sections at locations which are determined by reference to previously printed web marks. Systems of this type may be found, for example, in U.S. Pat. Nos. 3,195,385, 3,244,863 and 4,020,406.

It is further known to obtain a larger spacing between printed indicia on the moving web than would otherwise be dictated by the dimensions of the rotary printing drum by temporarily stopping the rotation of the drum at a point of non-contact between a printing element on the drum and the moving web, and subsequently restarting the rotation of the drum. Such a system is described, for example, in U.S. Pat. No. 4,057,014. The applicants are not aware, however, of any prior art printing system which periodically stops the rotation of a printing drum and is capable of printing indicia at the same position on a moving web with respect to previously printed web marks independent of the velocity of the web. Changes in the velocity of the web often occur when the printed web is being processed into packages, such as wrappers for candy bars. Moreover, no prior art printing system which periodically stops and starts the print head is known to applicants which permits an operator to adjust the offset distance between the printed indicia and the previously printed, evenly spaced web marks independent of the velocity of the web.

Printing systems are also known which have a rotating printing drum that is mechanically driven by the motion of a web on which indicia are to be printed. These mechanical systems print indicia on the moving web at the same location independent of velocity of the web, but do not control the print locations in response to previously printed web marks.

SUMMARY OF THE INVENTION

The present invention relates to a system for printing indicia on a moving web which uses a series of previously printed, evenly spaced web marks to control the spacing between the printed indicia. The system includes a rotary print head having at least one printing element disposed thereon for printing the indicia on the moving web which moves continuously from upstream of a printing position, to a printing position and then downstream of the printing position; a servo-controlled motor for rotating the printing elements disposed on the print head at a velocity substantially equal to the velocity of the moving web to form the indicia on the moving web when the printing elements contact the moving web; a web mark sensor, which may be part of an existing system to which the present invention is retrofitted, for detecting the passage of each web mark past a detection position to produce a web signal; means for generating a START signal after the closest web mark located downstream of the printing position has moved a predetermined percentage of the distance between adjacent web marks measured from the printing position; means for producing a STOP signal in order to bring the rotary print head after printing to a standstill when each of the printing elements thereon reaches a rest position; means for activating the motor in response to the START signal; and means for stopping the motor in response to each STOP signal.

A registration adjustment circuit is provided for varying the predetermined percentage of the distance between web marks in order to adjust the position of the leading edge of the indicia with respect to the closest downstream web mark.

The present invention has several advantages. The system permits the printing of indicia on a moving web at a fixed position with respect to previously printed web marks which is independent of the velocity of the web transport system. Different velocities or changes in velocity are commonplace in web handling systems, such as those used for making wrappers for candy bars. The printing system of the present invention is capable of being retrofitted to web handling systems of this kind and is substantially immune to such changes and variations in the web velocity. To this end, the system includes a registration adjustment circuit which permits variation of the position of the printed indicia with respect to the previously printed web marks in a manner that is independent of the velocity of the web.

A further advantage of the present printing system is that it may be retrofitted to existing web transport systems without substantial modification of those systems. The retrofitting may be accomplished by the connection of a tachometer to the existing web transport system and either the mounting of a new web mark detector for sensing the movement of the web marks past a detection position, or the utilization of an existing web mark detector. The system is also designed to permit it to be retrofitted to existing web processing systems which may move in either direction. Finally, the present system is capable of printing indicia at over 1000 images per minute.

DETAILED DESCRIPTION OF THE PREFERRED EMBODIMENT

Figure 1:
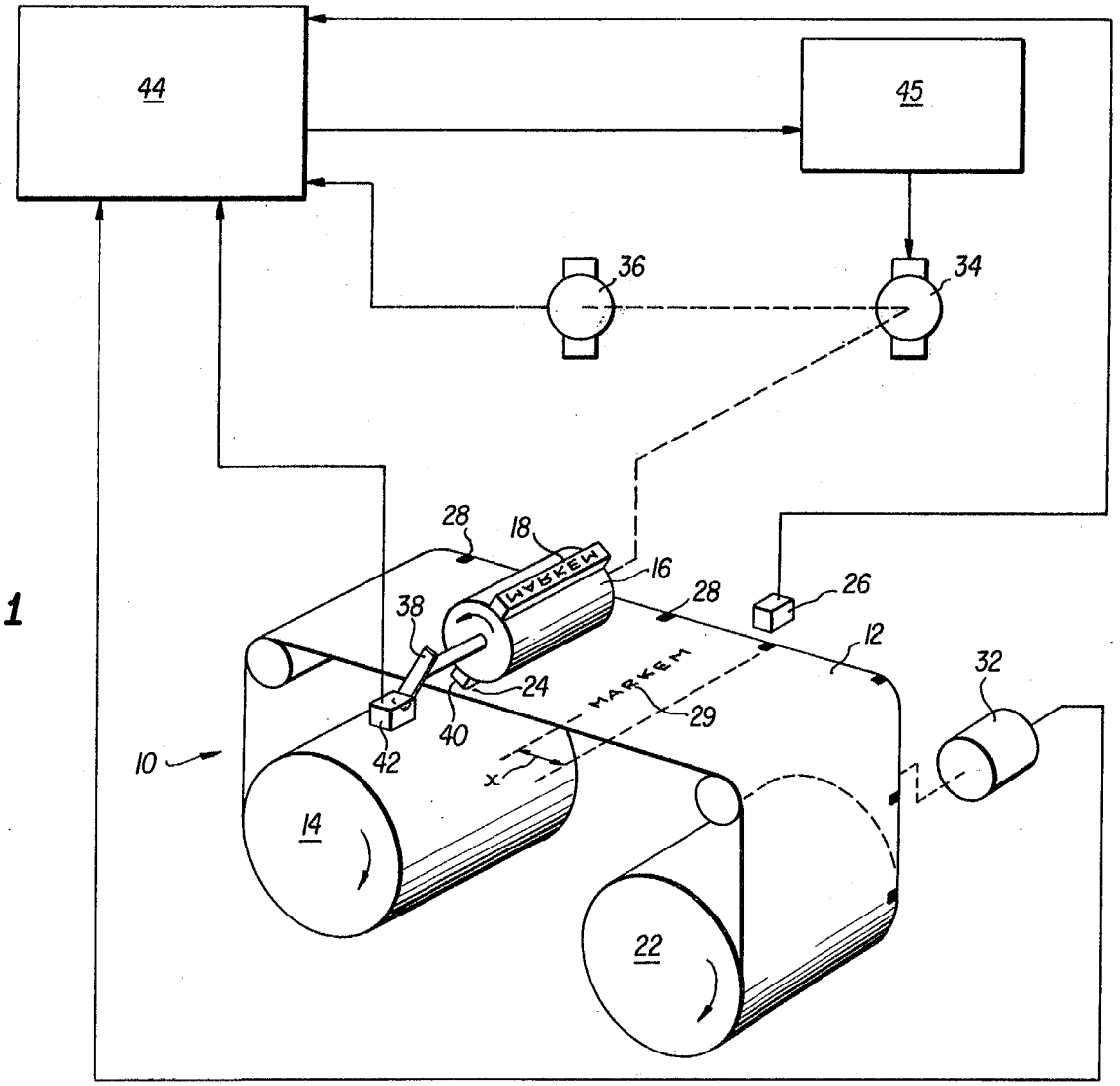
FIG. 1 is a system schematic diagram.

FIG. 1 illustrates a schematic diagram of a printing system in accordance with the present invention. A web transport mechanism 10 transports a web 12 from a supply roll 14 which is located upstream from a print position, to a print position at which is located a rotary print head 16 on which are peripherally mounted a pair of printing elements 18, past a web mark sensor 26 located downstream of the print position, and finally to a take-up roll 22. The web mark sensor 26 may be either a part of a previously existing system to which the invention is retrofitted or may be an integral part of the present invention. The position of the web sensor 26 may be alternatively located upstream of the print position. It should be noted that the design of the web transport system is conventional and does not itself form any part of the present invention. The point where the printing elements 18 contact the web 12 is defined as the printing position 24. The web mark sensor 26 functions to produce a web signal each time one of the plurality of evenly spaced, previously printed web marks 28 has moved past the web mark detection position at which the web mark sensor is mounted. The previously printed, evenly spaced web marks 28 are provided for controlling the spacing between indicia 29 which are formed on the web 12 by the printing elements 18.

In a manner to be described in detail hereinafter with reference to FIGS. 2 and 4, at the time of printing of the leading edge of a printed indicia 29, the distance designated as "x" between the leading edge of the indicia 29 and the closest downstream web mark 28 is a linear function of the output of the integrator 116 in FIG. 2.

The smallest possible print spacing between indicia which may be obtained by the present invention is slightly greater than the spacing between adjacent printing elements 18 when multiple printing elements are mounted on the print head 16 or slightly greater than the outside circumference of the print head 16 when only a single printing element 18 is mounted on the print head. This is due to the finite time required to accelerate the print head from the rest position to the velocity of the web and to decelerate the print head from the web velocity to a stop after a printing element has rotated to the rest position. The actual indicia are formed on the web 12 by rolling contact of the printing elements 18 across the web 12 at the printing position 24 when the peripheral velocity of the printing element is substantially equal to the linear velocity of the web 12. The spacing between adjacent web marks 28 controls the spacing between the successive indicia 29 which are printed on the web by the printing elements 18 in a manner to be explained in detail hereinafter.

A tachometer 32 is mechanically coupled to the web transport mechanism 10 to produce an output velocity command signal which is a linear function of the velocity of the web 12. A suitable motor 34 is provided for driving the rotary print head 16 at a peripheral velocity which is substantially equal to the linear velocity of the web during the time interval which begins when a START signal causes the velocity command signal from the tachometer to be coupled to the input of a servo amplifier and motor driver circuit 45, and ends when a STOP signal causes the velocity command to be disconnected from the input of the servo amplifier and motor driver circuit 45 in a manner hereinafter described in detail in conjunction with FIGS. 2 and 3. A print head tachometer 36 is mechanically coupled to the print head motor 34 for producing an output voltage which is a linear function of the rotational velocity of the print head. It should be noted that the location of the web tachometer 32 and print head tachometer 36 is not critical. Thus, for example, the web tachometer 32 may be driven by a follower wheel which makes rolling contact with the moving web at some point upstream or downstream of the print head 16, rather than being coupled directly to the web transport mechanism. A pair of diametrically opposed metallic vanes 38 which are mounted on the print head 16 for causing a fixed vane detector 42 to produce a signal when each printing element has rotated to a rest position 40. The number of vanes 38 is always equal to the number of printing elements 18. The vane detector 42 is mounted in proximity to the rotational path of the metallic vanes for detecting when one of the vanes is in the same angular orientation as the vane detector. Preferably, the vane detector 42 is a model 1AV Hall detector manufactured by the Microswitch division of Honeywell Corporation. However, it should be understood that the present invention is not limited to the choice of any particular type of position detector for determining the rest position 40 of the printing elements 18. The metallic vanes 38 should be affixed to the print head 16 and rotate in synchronism therewith, but the angular position of the vanes with respect to the print head is not critical as long as one of the vanes aligns with the vane detector 42 when the corresponding printing element 18 has reached the rest position. Each printing element assumes the fixed rest position 40 prior to making rotational contact with the web 12 to form indicia at the printing position 24. The rest position 40 of each printing element 18 is located a few degrees before the position at which the printing elements 18 make contact with the web 12 at the printing position 24 (i.e., just above the paper). The rest position 40 must be rotationally displaced from the printing position 24 sufficiently to provide enough time for the motor 34, after the occurrence of the START signal, to accelerate the printing elements up to a peripheral velocity substantially equal to the linear velocity of the web 12 by the time the printing element 18 is in rolling contact with the web at the printing position 24.

A registration circuit 44 is provided which is responsive to inputs from the web mark sensor 26, web tachometer 32, the print head tachometer 36 and the vane detector 42. The outputs from the registration circuit 44 are coupled to the servo amplifier and motor driver circuit 45 which drives the print head motor 34.

The registration circuit 44 performs two functions. The first function is that it produces the START and STOP signals. The START signal marks the beginning of the time that the motor 34 is running at a speed substantially equal to the linear velocity of the web 12 in response to the application of the velocity command signal from the web tachometer 32 to the servo amplifier and motor driver circuit 45. The STOP signal marks the beginning of the time interval that the motor 34 is stopped which occurs when the velocity command signal is not present at the input of the servo amplifier and motor driver circuit. The second function of the registration circuit 44 is the adjustment of the position of the indicia which are formed on the web with respect to web marks 28. For any given web mark spacing, the registration circuit functions to insure that the position of printing of the indicia on the web with respect to the web marks does not vary with the velocity of the web transport system. The precise manner in which the START and STOP signals are generated and the way that the registration adjustment is produced are described in detail with respect to FIG. 2.

Figure 2:
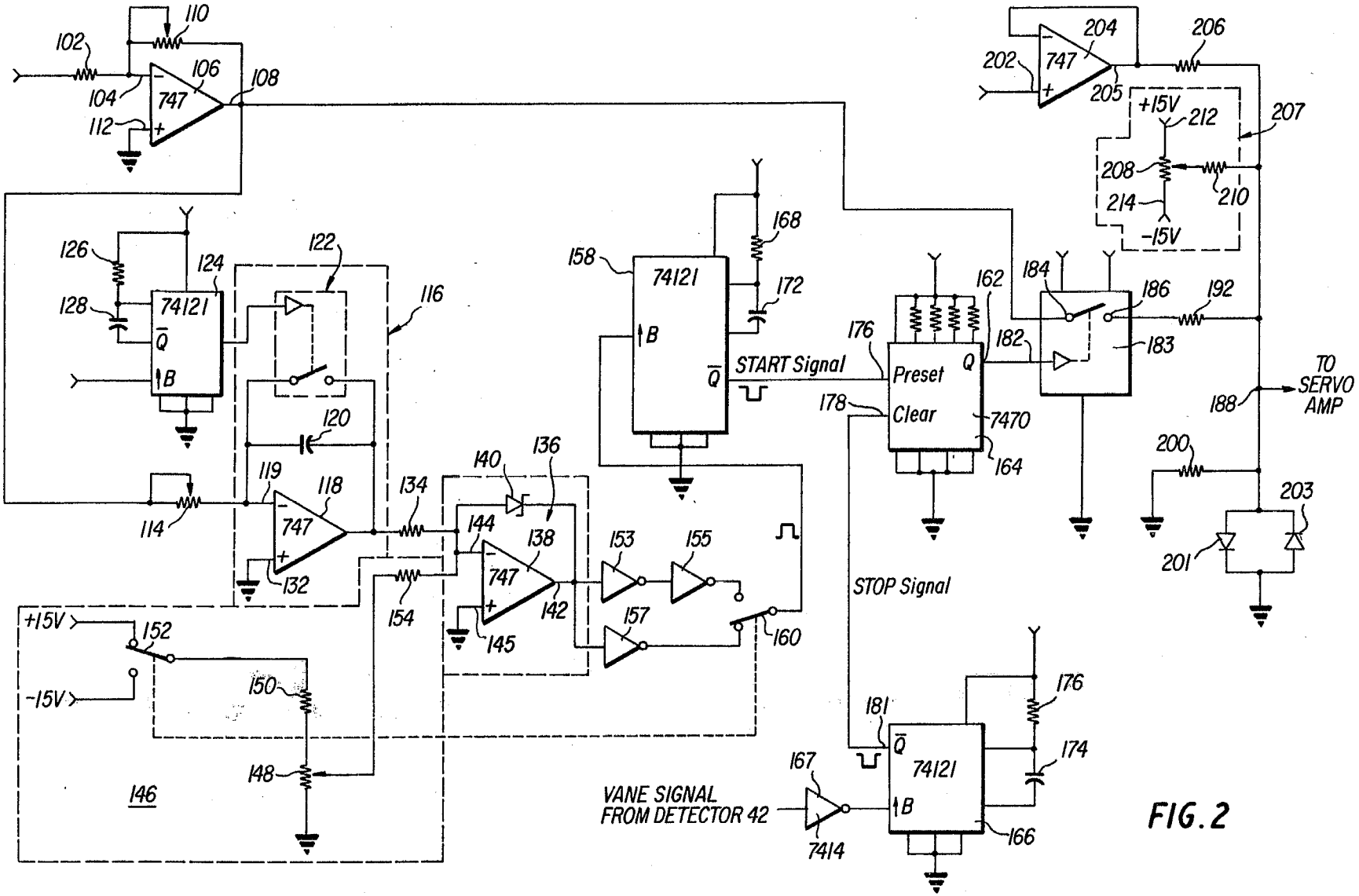
FIG. 2 is a circuit schematic of the registration circuit.

FIG. 2 illustrates a detailed circuit schematic of the registration circuit 44. It is assumed for purposes of the ensuing discussion that the web transport mechanism 10 is moving in the clockwise direction. The output from the web tachometer 32 (FIG. 5A) is a negative voltage which is applied through a 10K ohm resistor 102 to the inverting input 104 of an operational amplifier 106. The output 108 of the operational amplifier 104 is fed back to the input 104 via a potentiometer 110. The effective resistance of potentiometer 110 controls the relative gain of the operational amplifier 106 in a manner which is well understood to those skilled in the art. The noninverting input 112 to the operational amplifier 106 is connnected directly to ground. The positive polarity output of the operational amplifier 106 is connected via a 100K ohm potentiometer 114 to an integration circuit 116 which includes an operational amplifier 118, a storage capacitor 120 and an electronic reset switch 122 which discharges the voltage stored on the capacitor upon closure. The output from the operational amplifier 106 is coupled to the inverting input 119 of the operational amplifier 118.

For a constant web velocity, the integrator 116 functions to produce a negative going sawtooth voltage waveform (FIG. 5D) having a period equal to the time between web signals. The integrator is reset to zero upon each web signal (FIG. 5B) to produce the sawtooth, the instantaneous voltage level of which is directly proportional to the distance between the closest downstream web mark and the print position 24. When the leading edge of the indicia 29 is being formed on the web 12, the output of the integrator 116 is directly proportional to the distance "x" illustrated in FIGS. 2 and 4. It is to be understood that nonuniform web velocities will produce a voltage waveform that varies somewhat from the sawtooth illustrated in FIG. 5D, but the operation of the registration circuit of FIG. 2 will not be adversely affected thereby.

One shot multivibrator 124 produces a negative going output pulse (FIG. 5C) in response to each positive web signal (FIG. 5B) which is produced by web mark sensor 26. The leading edge of the positive going web signal is time coincident with the leading edge of the negative going output signal from one shot multivibrator 124. The time interval during which the one shot multivibrator 124 produces a negative going output pulse is determined by a 10K ohm resistance 126 and a 0.5 $\mu$F capacitor 128 in a manner which is understood by those skilled in the art. The output signal from the one shot multivibrator 124 is applied to the reset switch 122 which shorts the capacitor 120 each time a web signal is applied to the one shot multivibrator 124. The shorting of the capacitor 120 causes the sawtooth to rise from its maximum negative value to ground potential. The noninverting input 132 of the operational amplifier 118 is coupled to ground. As soon as the one shot multivibrator 124 has assumed its high level stable state after the application of the last web signal, the electronic switch 122 opens which permits the capacitor 120 to integrate the negative web tachometer output voltage to produce the sawtooth. The voltage on capacitor 120 reaches its maximum negative potential at the time of production of the next web signal by the web mark sensor 26. In the case where the closest web mark 28 has moved a distance equal to one half of the web mark spacing (i.e., one half of the distance between adjacent web marks) past the printing position, the voltage from integrator 116 will be equal to one half of the maximum voltage which is present at the time of the sensing of the next web mark.

Figures 5A, 5B, 5C, 5D, 5E, 5F, 5G, 5H, 5I, 5J:
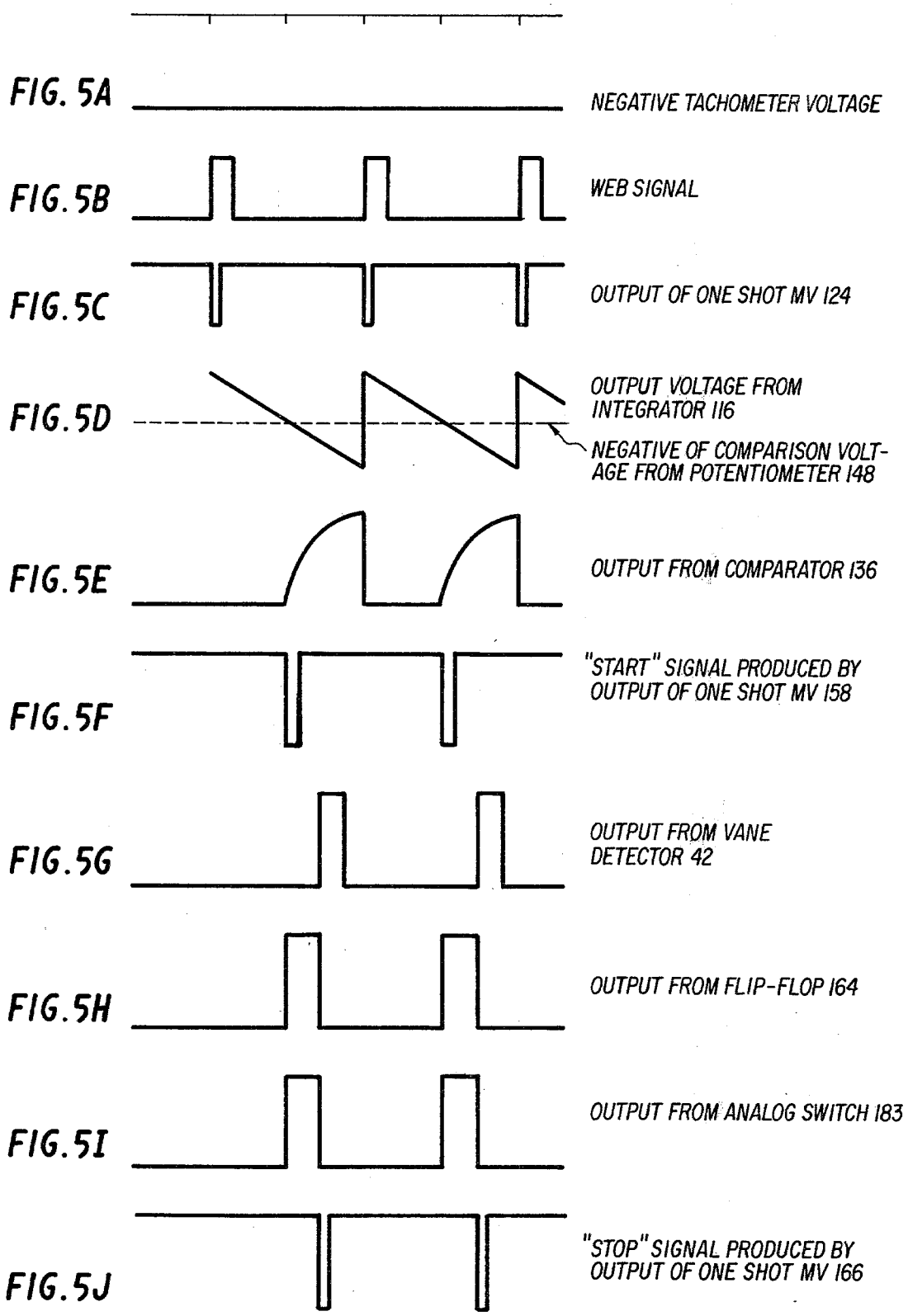
FIGS. 5A–J are timing diagrams illustrating the output signals from various parts of the schematic diagrams illustrated in FIGS. 1 and 2.

The output of the integrator circuit 116 is applied via a 100K ohm resistor 134 to a comparator 136 which consists of an operational amplifier 138 having a Zener feedback diode 140 coupled between the output 142 and the inverting input 144. Noninverting input 145 is connected to ground. The comparator 136 functions to produce a high level output (FIG. 5E) whenever the sum of the voltages applied to the inverting input is negative and zero when the sum is positive. As illustrated, the comparator 136 produces a positive level when the input 144 is negative polarity. As the change from positive polarity to negative polarity occurs at input 144, the Zener diode 140 becomes reverse biased. The reverse biased Zener diode represents a high impedance which causes the gain of the operational amplifier 138 to become high because the ratio of the feedback impedance to the input impedance is now much larger than when the composite signal at input 144 of the operational amplifier 138 was positive which forward biased the Zener diode. An adjustment circuit 146 consisting of a 50K ohm potentiometer 148, a 22K ohm resistance 150, switch 152 which is selectively connectable to either a positive 15 volt potential or a negative 15 volt potential depending on the direction of rotation of the print head 16, and a 100K ohm input resistance 154 is provided for applying a variable input potential to the input 144 of comparator 136. The negative of the comparison voltage produced by the adjustment circuit 146 is illustrated in FIG. 5D as a dotted line. The switch 152 is selectively connected to the 15 volt positive potential for clockwise rotation of the print head 16, or to the 15 volt negative potential for counterclockwise rotation of the print head 16. The setting of the wiper of potentiometer 148 determines the magnitude of the positive or negative comparison voltage which is coupled to the input 144 of comparator 136. The magnitude of the positive or negative comparison voltage in turn determines the time at which the input 144 changes polarity to cause a change in the output level of the comparator 136. For clockwise rotation, the time at which the input 142 to the comparator 136 changes polarity from positive to negative marks the beginning of the START signal. For counterclockwise rotation, the time at which the input 142 to the comparator 136 changes polarity from negative to positive marks the beginning of the START signal.

Upon occurrence of the START signal, the print head motor 34 (FIG. 1) rotates the lower printing element 18 from the rest position 40 to the printing position 24 to form indicia 29 on the moving web 12 and past the printing position until the upper printing element 18 has rotated to the rest positon 40. For a setting of the effective resistance of potentiometer 148 of 25K ohms, the sawtooth output of the integrator 116 will reach one half of its maximum negative voltage at the time the comparator produces a positive output level. For a 25K ohm setting of the potentiometer 146, therefore, the leading edge of the indicia will be located midway between the web marks 28 as schematically depicted in FIG. 4. This relationship is preserved for successive prints despite changes and variations in the web velocity.

The location of the printed indicia 29 could be varied by angular adjustment of the vane sensor 42 with respect to the print head 16. However, the present invention does not rely on the adjustment of the angular position of the vane sensor 42 to vary the location of the printed indicia 29 with respect to the web marks 28.

With further reference to FIG. 2, the output from comparator 136 is applied to a pair of inverting Schmitt triggers 153 and 155 which function to convert the output signal from the comparator 136, which is not a sharply defined square wave (FIG. 5E), into a square wave having the same polarity as the output from the comparator. The output from the inverter 155 produces a signal having a positive going leading edge at the time the polarity of input 144 goes positive when the transport system is moving in the counterclockwise direction. The output of the comparator 136 is also connected to an inverting Schmitt trigger circuit 157 which functions to modify the output pulse from the comparator 136 into a sharply defined square wave having a positive going leading edge at the point in time that the input 144 goes negative for clockwise rotation. The outputs from the inverting circuits 153 and 157 are selectively connected to the input of one shot multivibrator 158 by a switch 160 which is ganged to switch 152. Switch 160 is connected to the appropriate output of either inverting circuit 155 or 157 to couple the positive going edge from either inverting circuits 153 or 157 to the one shot multivibrator 158. The positive-going leading edge of the output pulse from the inverting circuit 155 or 157 is coincident in time with the beginning of the START signal, which is produced by the $\overline{Q}$ output 161 of one shot multivibrator 158. The START signal defines the beginning of the time interval during which the velocity command signal from the web tachometer 32 is applied to the input of the servo amplifier 190 in a manner to be explained hereinafter. The end of the time interval during which the velocity command signal from the tachometer 32 is applied to motor 34 is defined by the beginning of the STOP signal.

A second one shot multivibrator 166 is coupled to the output of the vane detector 41 via inverter 167 to produce an output pulse when one of the printing elements 18 has rotated to the rest position 40. The output pulse from the one shot multivibrator 166 is the STOP signal. The STOP signal defines the beginning of the time interval during which the print head motor 34 is stopped as a consequence of the input to the servo amplifier being disconnected from the velocity command signal from tachometer 32 in a manner to be explained shortly. The end of the time interval during which motor 34 is stopped is marked by the beginning of the START signal. The astable-state duty cycles of the respective one shot multivibrators 158 and 166 are controlled by the external resistances 168 and 176 and the external capacitances are 172 and 174 in the manner understood by those skilled in the art. The output from the first one shot multivibrator 158 is coupled to the toggle input 176 of the flip-flop 164. An output pulse from one shot 158 produces a high signal on the Q output 162 of flip-flop 164. The output of the second one shot multivibrator 166 is applied to the reset input 178 of the flip-flop 164 to cause the flip-flop 164 to be triggered into a reset condition. The Q output 162 of the flip-flop 164 is connected to the control terminal 182 of an analog switch 183. Terminal 184 of the analog switch 183 is connected directly to the output 108 of the operational amplifier 106 which amplifies the velocity command signal produced by the web tachometer 32. The terminal 186 is connected to a 10K ohm resistor 192 which is connected to the input 188 of servo amplifier 190. A pair of oppositely poled diodes 201 and 203 are connected between ground and the input 188 of servo amplifier 190 to bias the input one diode voltage drop above or below ground. A 5.1K ohm resistance 200 is coupled between ground and the input 188 of the servo amplifier 190. A high level signal from the Q output 162 of flip-flop 164 causes the analog switch 183 to close. When analog switch 183 closes, the velocity command signal from the web tachometer 32 is coupled to the input 188 of the servo amplifier 190 via operational amplifier 106. A high level signal on the Q output 162 causes the command velocity from the web tachometer 32 to be coupled to the servo amplifier 190 commencing with the beginning of the START signal. The STOP signal resets the flip-flop 164 which causes the analog switch 183 to open causing the disconnection of the command velocity from the servo amplifier 190. The output of the print head tachometer 36 is applied to the noninverting input 202 of an operational amplifier 204. The output 205 of the operational amplifier 204 is connected to the input 188 of the servo amplifier 190 via a 5.1K ohm resistance 206. An offset adjustment 207 is provided which consists of a 100K ohm potentiometer 208 coupled to the input 188 of the servo amplifier 190 via a 100K resistor 210. The terminals 212 and 214 of the 100K potentiometer 208 are respectively connected to a source of a +15 volt potential and a source of −15 volt potential. The offset adjustment 207 is adjusted so that the motor 34 for driving the print head 16 is just stopped when the command velocity is disconnected from the input 188 of the servo amplifier 190 by the opening of analog switch 183.

Figure 3:
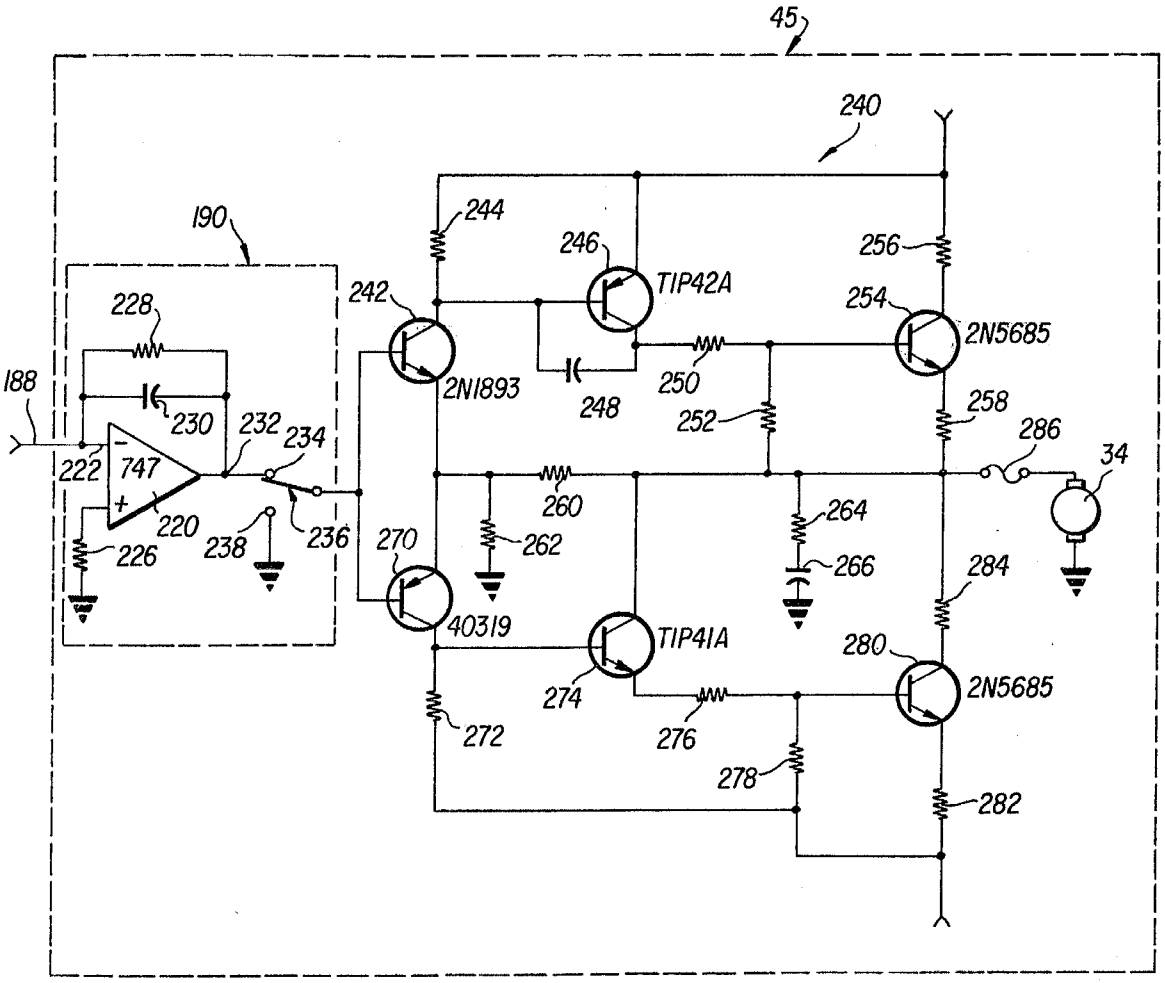
FIG. 3 is a circuit schematic of the servo amplifier and motor driver circuit.

FIG. 3 illustrates a detailed circuit schematic of the servo amplifier 190 and motor driver amplifier 240 for driving the print head motor 34. The servo amplifier includes an operational amplifier 220 having an inverting input terminal 222. The noninverting input 224 of the operational amplifier 220 is coupled to ground by means of a 10K ohm resistor 226. A 1.5K ohm feedback resistance 228 is provided to stabilize the operational amplifier. A feedback capacitance 230 is provided to substantially attenuate the effects of any AC components that may be present in the START and STOP signals and which could otherwise deleteriously influence the operation of the DC motor 34 during the printing interval. The output 232 of the operational amplifier 220 is connected to terminal 234 of a switch 236 which selectively permits the motor 34 to be either responsive or nonresponsive to the effects of the START and STOP signals. Terminal 238 of the switch 236 is connected to ground. When the present system is in its "run" mode, as illustrated, the output of the operational amplifier 220 is connected directly to the input of a push-pull amplifier 240 via the closed switch 236. When the system is in a "stopped" mode, the terminal 238 of the switch is connected to the input of the push-pull amplifier 240.

The push-pull driver amplifier 240 functions to provide sufficient power for the rotation of the DC motor 34 in either a clockwise or counterclockwise direction. The top half of the push-pull configuration, which consists of NPN transistor 242, 1K ohm resistor 244, PNP transistor 246, feedback capacitor 248, 7.5 ohm resistor 250, 470 ohm resistor 252, NPN transistor 254, 0.3 ohm resistor 256, and 0.75 ohm resistor 258 and common 220 ohm resistance 260, 100 ohm resistance 262, 10 ohm resistance 264 and common 1 μF capacitor 266, functions to amplify positive going output voltages from servo amplifier 190 when the system is running in a clockwise direction as illustrated in FIG. 2. The bottom half of the push-pull amplifier 240, which consists of PNP transistor 270, 1K ohm resistance 272, NPN transistor 274, 7.5 ohm resistance 276, 470 ohm resistance 278, NPN transistor 280, 0.75 ohm resistance 282 and 0.3 ohm resistor 284, and common resistances 260, 262 and 264, and capacitor 266, functions to amplify negative output voltages from servo amplifier 190 which occur when the system is running in a counterclockwise direction. The push-pull amplifier 240 is connected via a fuse 286 to the DC print head motor 34, which is preferably a PMI Corporation Model U12M4 direct current motor.

Figure 4:
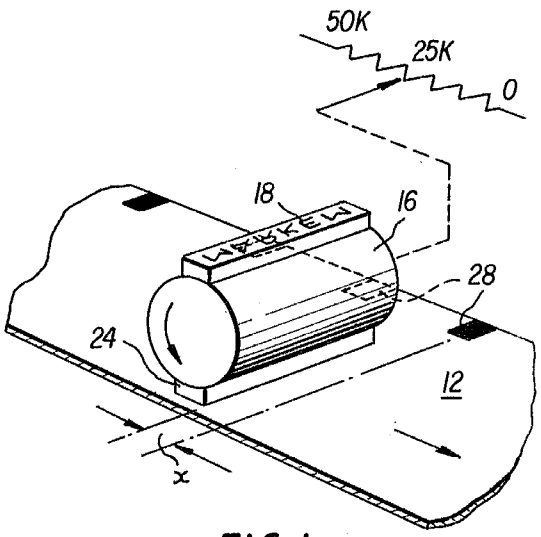
FIG. 4 illustrates the relationship between the position of the registration adjustment potentiometer of FIG. 2. and the position of the indicia with respect to the previously printed web marks.

FIG. 4 illustrates the relationship between the setting of the 50K ohm potentiometer 148 and the offset distance "x", which is the distance between the closest web mark 28 located downstream of the printing position and the leading edge of the printed indicia. Specifically, when the 50K ohm registration potentiometer 148 is set to couple 25K ohms of resistance to the input of the comparator 136, the offset distance will be equal to one half of the distance between web marks 28. The percentage of the 50K ohm resistance of registration adjustment potentiometer 148 which is connected to the input of the comparator 134 is directly proportional to the offset distance. Thus, for example, a setting of the potentiometer 148 which couples one quarter of the 50K ohm resistance to the input of the comparator 34 will produce an offset distance equal to one quarter of the distance between web marks 28.

It should be appreciated that the offset distance "x" may, if desired, be measured from some reference point in the web other than the web marks themselves. This may be accomplished by moving the web detector 26 to some other point along the web 12, or by adjusting the vane 38 or vane sensor 42 to relocate the rest position 40 of the printing elements 18 to an angular position further in advance of the point of contact with the web 12. This modification may be useful, for example, in systems where the web marks define the edges of the individual wrappers or labels that are to be cut from the web, and the indicia are to be printed close to one of the edges of each wrapper or label. In these systems, it may be convenient to measure the offset distance "x" from a point near the center of each web segment (i.e., midway between adjacent web marks) since this would place the print location near the edge of the web segment when the potentiometer 148 is set to its 25K-ohm middle value.

The operation of the present invention is best understood with reference to the timing diagram of FIG. 5, which illustrates the output signals from various elements illustrated in FIGS. 1 and 2. Prior to the starting of the printing system, the operator adjusts the registration adjustment potentiometer 148 to set the desired offset distance "x". The relationship between the setting of the registration adjustment potentiometer 148 and the offset distance "x" has been discussed in detail above with reference to FIG. 4. After the operator has chosen the desired offset distance, the ganged switches 152 and 160 are positioned to set the system for either clockwise or counterclockwise rotation depending on the direction of rotation of the print head 16. Once the web transport system is started, a voltage is produced by the tachometer 32 which is directly proportional to the velocity of the web.

FIG. 5A illustrates the negative potential output from the web tachometer 32 for clockwise rotation. If the web 32 is moving in the counterclockwise rotation, the output potential would instead be positive.

FIG. 5B illustrates the web signals which are produced by the web mark sensor 26 each time a web mark 28 passes the web mark detector 26, these signals being applied to the input of one shot multivibrator 124.

FIG. 5C illustrates the output from the one shot multivibrator 124 which periodically closes analog switch 122 to discharge the capacitor 120. The pulses from the one shot multivibrator 124 mark the beginning and end of the duty cycle of the sawtooth wave of FIG. 5D.

FIG. 5D illustrates the output of integration circuit 116. For cases in which the web velocity is constant, the output of integration circuit 116 will have a conventional sawtooth waveshape as shown. After the output of the multivibrator 124 has gone low, the positive output voltage from operational amplifier 118, which is applied to the inverting input 144 of the integration circuit 116, is integrated to produce a sawtooth as illustrated. At any given instant in time, the output of integrator 120 is directly proportional to the distance between the printing position 24 and the downstream web mark 28 located closest to the printing position. At the time that the leading edge of the indicia 29 is formed on the web 12, the output of the integrator 116 is directly proportional to the offset distance "x" of FIGS. 1 and 4.

FIG. 5E illustrates the output signal from the comparator 136 which is produced when the registration adjustment potentiometer 148 has been set so that 25K ohms of its maximum 50K ohm resistance is coupled to the input of the comparator. In this case, when the output voltage of the integrator rises to one half of the maximum negative potential illustrated in FIG. 5D, the polarity of the input voltage applied to the inverting input 144 of the operational amplifier 138 changes polarity from positive to negative. At the precise time that the input 144 changes from positive to negative, the voltage which is coupled to the input 144 from the registration adjustment potentiometer 148 is equal in magnitude to the output of integrator 116 but of opposite polarity. The dotted line in FIG. 5D illustrates the negative of the comparison voltage which is coupled to the input 144 of operational amplifier 138 by the adjustment circuit 146. When the polarity change occurs, the Zener diode 140 becomes reverse biased, which causes the effective feedback resistance of the operational amplifier 138 to be high. The high feedback resistance attributable to the reverse-biased Zener diode 140 increases the gain of the operational amplifier 138 to a point where a positive output signal is produced at the output of the comparator 136. The output signals from the comparator 136 are not true square waves. The inverting Schmitt trigger circuits 153 and 155 (for counterclockwise rotation) or 157 (for clockwise rotation) convert the output pulses from the comparator 136 into true square waves.

FIG. 5F illustrates the START signal from the one shot multivibrator 158. The START signal marks the beginning of the time interval during which the velocity command signal from the web tachometer 32 is applied to the input of the servo amplifier 190.

FIG. 5G illustrates the vane signal which is produced by the vane detector 42 illustrated in FIG. 1. Multivibrator 166 produces the STOP signal (FIG. 5J) each time a pulse from the vane detector 42 is applied to its input.

FIG. 5H illustrates the Q output 162 of flip-flop 164. The Q output from the flip-flop 164 is triggered to a high level at the beginning of the START signal.

FIG. 5I illustrates the output voltage from the analog switch 182. The voltage on terminal 186 of the analog switch 182 is equal to the output voltage of the operational amplifier 106 and is an amplified inversion of the velocity command signal from the web tachometer 32.

FIG. 5J illustrates the STOP signal which is produced by the Q output 181 of one shot multivibrator 166. The STOP signal resets flip-flop 164 to cause analog switch 183 to open, thereby disconnecting the amplified and inverted command voltage produced by the tachometer 32 from the input 188 of the servo amplifier 190. The motor 34 is stopped when the command voltage is disconnected from the input 188 of servo amplifier 190.

The time interval that the command signal from the web tachometer 32 is coupled to the motor 34 is defined by the time between the beginning of the START and STOP signals. The servo amplifier 190 causes the speed of the DC motor to closely track the velocity of the web 12 during this interval. The push-pull amplifier 240 amplifies the output of the servo amplifier 190 to a sufficient power level to drive the print head motor 34 to make clear prints.

While the present invention has been described with reference to a preferred embodiment, it is to be understood that the invention is not limited to the details thereof. Thus, for example, the velocity of web to be printed need not be constant as described, but may instead be nonuniform or even discontinuous (i.e., intermittent). As pointed out earlier, nonuniform web transport velocities are common and often unavoidable in web handling systems in which a number of different operations are being performed at different points on the moving web, and the present invention is specifically intended to be usable in connection with systems of this type. In addition, the term "web" as used herein is not intended to restrict the invention to the use of a continuous strip of paper or other material as shown in the drawings, but is also intended to embrace equivalent structures such as a series of discrete sheets or labels carried on the surface of a continuous conveyor belt. It will also be appreciated that the web marks need not take the form of printed marks on the web as illustrated. Depending on the type of web sensor employed, the web marks may alternatively be holes, slots, or even conductive metallic areas detectable by suitable electrical contacts or brushes. Finally, it should be understood that no particular choice of circuit components such as operational amplifiers, one shot multivibrators, and so on, is necessary to the practice of the present invention. Many other such substitutions and modifications will occur to those of ordinary skill in the art, and all such substitutions and modifications are intended to fall within the scope of the present invention as defined in the appended claims.

What is claimed is:

1. A printing system for use in printing indicia on a moving web having a series of evenly spaced web marks for controlling the spacing between the indicia printed on the web, said web moving from a position upstream of a printing position, to the printing position where the indicia are formed, and to a position downstream from the printing position, comprising:

(a) a rotary print head having at least one printing element disposed thereon for printing the indicia on the moving web;

(b) means for rotating the print head at a velocity substantially equal to the velocity of the moving web to form the indicia on the moving web when the printing elements contact the moving web at the printing position;

(c) means for detecting each web mark to produce a web signal in response to the movement of each web mark past a detection position;

(d) means for generating a START signal after the closest downstream web mark has moved a predetermined percentage of the distance between adjacent web marks from the printing position;

(e) means for detecting when each printing element rotates to a predetermined rest position at which the printing element is not in contact with the web, and for producing a STOP signal in response to the detection of said rest position;

(f) means for activating the means for rotating in response to the START signal to cause the leading edge of the indicia to be printed on the web at the printing position when the printing position is separated from the closest downstream web mark by a distance which is equal to the predetermined percentage of the distance between adjacent web marks; and (g) means for stopping the means for rotating in response to the STOP signal.

2. A printing system in accordance with claim 1 further comprising means for varying said predetermined percentage, whereby the position of the printed indicia on the web with respect to the web marks may be changed.

3. A printing system in accordance with claim 2 further comprising:

(a) a web tachometer having an output on which is produced an output signal having a magnitude which is a linear function of the web velocity;

(b) a print head tachometer having an output on which is produced an output signal which is a linear function of the rotational velocity of the print head;

(c) means for coupling the web tachometer output to the means for activating in response to the START signal; and wherein (d) the means for activating comprises a servo amplifier having an input and an output, the input being coupled to the output of the print wheel tachometer and the output of the web tachometer; and (e) the means for generating the START signal comprises:

(i) means for integrating the signal produced by the web tachometer, (ii) means for resetting the integrated signal of the web tachometer in response to each web signal, (iii) means for comparing the magnitude of the integrated web signal with a predetermined voltage to produce an output signal at an output when the sum of the output from the means for integrating and the predetermined voltage changes polarity, and (iv) a first one shot multivibrator coupled to the output of the means for comparing for producing the START signal on an output, the output of the first one shot being coupled to the means for coupling the web tachometer output to the means for activating.

4. A printing system in accordance with claim 3 wherein the means for detecting when each printing element rotates to a rest position and for producing a STOP signal comprises:

(a) a vane sensor mounted in proximity to the print head and one or more equally spaced vanes mounted to rotate with the print head for producing an output pulse on an output each time a vane rotates in proximity to the vane sensor, the number of vanes being equal to the number of printing elements; and (b) a second one shot multivibrator having an input coupled to the output of the vane sensor for producing the STOP signal on an output in response to each vane signal, the output of the second one shot multivibrator being coupled to the means for coupling the web tachometer output to the means for activating.

5. The printing system in accordance with claim 3 wherein the means for coupling the web tachometer output voltage to the means for activating comprises:

(a) a flip-flop having a first input coupled to the output of the first one-shot multivibrator which causes the flip-flop to change state in response to a START signal and a second input coupled to the output of the second one-shot multivibrator for resetting the flip-flop in response to the STOP signal; and (b) a switching means having a control terminal which is coupled to the output of the flip-flop, the switching means having two additional terminals, one of the terminals being coupled to the output of the web tachometer and the other terminal being coupled to the input of the means for activating, the application of the output signal from the output of the flip-flop to the control terminal of the switching means causing the output from the web tachometer to be applied to the input of the means for activating and the discontinuance of an output signal from the flip-flop causing the output from the web tachometer to be disconnected from the input of the servo amplifier.

6. A printing system in accordance with claim 5 wherein the means for activating comprises:

(a) a servo system having an input coupled to the output of the switching means and an output;

(b) an amplifier having an input coupled to the output of the servo system and an output, and wherein (c) the means for rotating comprises a DC motor having an input coupled to the output of the amplifier.

7. A printing system for use in printing indicia on a web that is moved by a web transport system, said web having a series of evenly spaced web marks for controlling the spacing between the indicia printed on the web, said web moving from a position upstream of a printing position, to the printing position where the indicia are formed, and to a position downstream from the printing position, said web transport system includes means for detecting each web mark to produce a web signal in response to movement of each web mark past a predetermined position, comprising:

(a) a rotary print head having at least one printing element disposed thereon for printing the indicia on the moving web;

(b) means for rotating the print head at a velocity substantially equal to the velocity of the moving web to form the indicia on the moving web when the printing elements contact the moving web at the printing position;

(c) means for generating a START signal after generation of said web signal and after the closest downstream web mark has moved a predetermined percentage of the distance between adjacent web marks from the printing position;

(d) means for detecting when each printing element rotates to a predetermined rest position at which the printing element is not in contact with the web, and for producing a STOP signal in response to the detection of each rest position;

(e) means for activating the means for rotating in response to the START signal to cause the leading edge of the indicia to be printed on the web at the printing position when the printing position is separated from the closest downstream web mark by a distance which is equal to the predetermined percentage of the distance between adjacent web marks; and (f) means for stopping the means for rotating in response to the STOP signal.

8. A printing system in accordance with claim 7 further comprising means for varying said predetermined percentage, whereby the position of the indicia on the web with respect to the web marks may be changed.

9. A printing system in accordance with claim 8 further comprising:

(a) a web tachometer having an output on which is produced an output signal having a magnitude which is a linear function of the web velocity;

(b) a print head tachometer having an output on which is produced an output signal which is a linear function of the rotational velocity of the head;

(c) means for coupling the web tachometer output to the means for activating in response to the START signal; and wherein (d) the means for activating comprises a servo amplifier having an input and an output, the input being coupled to the output of the print wheel tachometer and the output of the web tachometer; and (e) the means for generating the START signal comprises:

(i) means for integrating the signal produced by the web tachometer, (ii) means for resetting the integrated signal of the web tachometer in response to each web signal, (iii) means for comparing the magnitude of the integrated web signal with a predetermined voltage to produce an output signal at an output when the sum of the output from the means for integrating and the predetermined voltage changes polarity, and (iv) a first one shot multivibrator coupled to the output of the means for comparing for producing the START signal on an output, the output of the first one shot being coupled to the means for coupling the web tachometer output to the means for activating.

10. A printing system in accordance with claim 9 wherein the means for detecting when each printing element rotates to a rest position and for producing a STOP signal comprises:

(a) a vane sensor mounted in proximity to the print head and one or more equally spaced vanes mounted to rotate with the print head for producing an output pulse on an output each time a vane rotates in proximity to the vane sensor, the number of vanes being equal to the number of printing elements; and (b) a second one shot multivibrator having an input coupled to the output of the vane sensor for producing the STOP signal on an output in response to each vane signal, the output of the second one shot multivibrator being coupled to the means for coupling the web tachometer output to the means for activating.

11. The printing system in accordance with claim 9 wherein the means for coupling the web tachometer output voltage to the means for activating comprises:

(a) a flip-flop having a first input coupled to the output of the first one-shot multivibrator which causes the flip-flop to change state in response to a START signal and a second input coupled to the output of the second one-shot multivibrator for resetting the flip-flop in response to the STOP signal; and (b) a switching means having a control terminal which is coupled to the output of the flip-flop, the switching means having two additional terminals, one of the terminals being coupled to the output of the web tachometer and the other terminal being coupled to the input of the means for activating, the application of the output signal from the output of the flip-flop to the control terminal of the switching means causing the output from the web tachometer to be applied to the input of the means for activating and the discontinuance of an output signal from the flip-flop causing the output from the web tachometer to be disconnected from the input of the servo amplifier.

12. A printing system in accordance with claim 11 wherein the means for activating comprises:

(a) a servo system having an input coupled to the output of the switching means and an output;

(b) an amplifier having an input coupled to the output of the servo system and an output, and wherein (c) the means for rotating comprises a DC motor having an input coupled to the output of the amplifier.

* * * * *